US010119216B2

(12) United States Patent
Sharp

(10) Patent No.: US 10,119,216 B2
(45) **Date of Patent: *Nov. 6, 2018**

(54) LAUNDRY TREATING APPLIANCE WITH TUB AND BASKET HAVING MATCHED CHARACTERISTICS

(71) Applicant: WHIRLPOOL CORPORATION, Benton Harbor, MI (US)

(72) Inventor: Brenner M. Sharp, Bridgman, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 430 days.

This patent is subject to a terminal disclaimer.

(21) Appl. No.: 15/005,359

(22) Filed: Jan. 25, 2016

(65) Prior Publication Data

US 2016/0138206 A1 May 19, 2016

Related U.S. Application Data

(63) Continuation of application No. 14/056,182, filed on Oct. 17, 2013, now Pat. No. 9,284,672.

(51) Int. Cl.

| | |
|---|---|
| ***D06F 23/04*** | (2006.01) |
| ***D06F 13/02*** | (2006.01) |
| ***D06F 37/36*** | (2006.01) |
| *D06F 39/08* | (2006.01) |
| *D06F 33/02* | (2006.01) |
| *D06F 37/24* | (2006.01) |

(52) U.S. Cl.
CPC ..... *D06F 23/04* (2013.01); *D06F 13/02* (2013.01); *D06F 37/36* (2013.01); *D06F 33/02* (2013.01); *D06F 37/24* (2013.01); *D06F 39/085* (2013.01)

(58) Field of Classification Search
None
See application file for complete search history.

(56) References Cited

U.S. PATENT DOCUMENTS

| | | | |
|---|---|---|---|
| 5,373,715 | A | 12/1994 | Sharp et al. |
| 2010/0251781 | A1 | 10/2010 | Lee et al. |
| 2012/0055204 | A1 | 3/2012 | Sun |
| 2012/0272690 | A1 | 11/2012 | Vincent et al. |
| 2012/0304703 | A1 | 12/2012 | Kim et al. |
| 2013/0014547 | A1 | 1/2013 | Kim et al. |
| 2013/0031938 | A1 | 2/2013 | Cho et al. |
| 2013/0036776 | A1 | 2/2013 | Seo et al. |

FOREIGN PATENT DOCUMENTS

| | | | |
|---|---|---|---|
| JP | 02088099 | A | 3/1990 |
| JP | 06071090 | A | 3/1994 |
| JP | 10179977 | A | 7/1998 |
| JP | 11276774 | A | 10/1999 |
| JP | 2013056077 | A | 3/2013 |
| JP | 2013056078 | A | 3/2013 |
| KR | 20090101713 | A | 9/2009 |

*Primary Examiner* — Rita P Adhlakha

(57) ABSTRACT

A laundry treating appliance may include a tub and a basket located at least partially within the tub and at least partially defining a laundry treating chamber. A drive system may operatively couple the tub to the basket and may be operative to rotate the basket about a rotational axis. The tub and the basket may each have similar deflection.

12 Claims, 3 Drawing Sheets

LAUNDRY TREATING APPLIANCE WITH TUB AND BASKET HAVING MATCHED CHARACTERISTICS

CROSS REFERENCE TO RELATED APPLICATIONS

The present application is a continuation of U.S. patent application Ser. No. 14/056,182, filed Oct. 17, 2013, now U.S. Pat. No. 9,284,672, issued Mar. 15, 2016, which is incorporated herein by reference in its entirety.

BACKGROUND

In the competitive market of laundry treating appliances, certain features, such as load capacity, are highly desirable to customers. Load capacity, or the amount of laundry that fits within the appliance for treatment, can translate to, for example, energy, economic, and time-saving benefits as a user may be able to treat the same amount of laundry in less time due to a smaller overall number of separate loads. Additionally, a larger load capacity may allow a user to treat bulky items at home rather than at a special laundry facility. As laundry treating appliances have industry standards for their outer form factor, it makes it very difficult to increase the capacity of the appliance.

BRIEF SUMMARY

A laundry treating appliance according to one embodiment may comprise a tub having a base with a first effective stiffness, a basket located at least partially within the tub and at least partially defining a laundry treating chamber, the basket having a base with a second effective stiffness, and a drive system operatively coupling the tub to the basket and operative to rotate the basket about a rotational axis. The first effective stiffness and the second effective stiffness may be matched.

DETAILED DESCRIPTION

Figure 1:
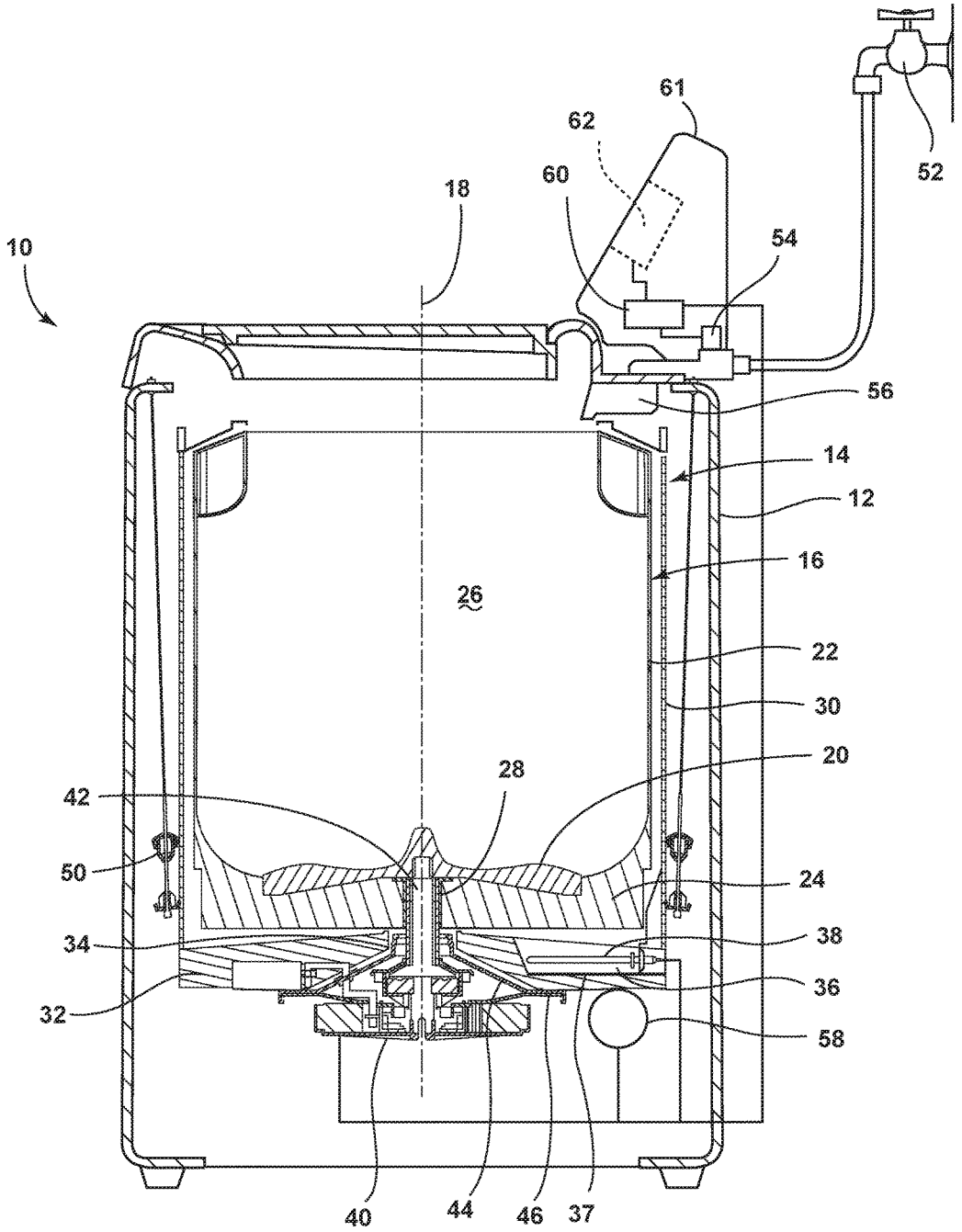
FIG. 1 is a schematic sectional view of a laundry treating appliance in the form of a washing machine.

Automatic washing machines may typically comprise a perforated basket or drum for holding a laundry load, which may include garments, sheets, towels, and other fabric items, and an imperforate tub containing a liquid typically comprising water or a mixture of water and detergent or other treatment aid. A laundry mover may be coaxially mounted in the bottom of the basket and adapted for angular oscillation in order to agitate the laundry load. In one configuration, the basket, the laundry mover, and the tub may be oriented about a vertical axis.

Traditionally, a vertical axis laundry mover may be configured as an impeller or an agitator. The impeller is typically a low-profile base element having a circular periphery, with protrusions extending upward from the base element. The agitator typically has a base, which may be in combination with an auger that extends along the vertical axis approximately the height of the tub.

It is generally understood that a deep fill wash cycle, typically associated with an agitator, refers to a cloth to liquid ratio that, when combined with the action of the laundry mover, produces fluid motion which significantly aids in the motion of the laundry items even if the actual liquid level in the machine is not near the top of the basket. In a deep fill wash cycle, the liquid is normally filled to a height above the height the laundry takes when saturated and causes the laundry to be "buoyant" to the extent possible. The laundry is considered suspended in the free fluid, or submerged, when there is sufficient fluid power to directly result in movement of the laundry. The combination of the agitator contacting the laundry, the liquid moving through the laundry, and the relative contact between the laundry items contribute to imparting mechanical energy to the laundry for cleaning.

Likewise, a low fill wash cycle, also called a low water wash cycle and typically associated with an impeller, generally refers to a cloth to liquid ratio that, when combined with the action of the laundry mover, produces insufficient fluid motion to directly result in cloth motion regardless of the direction of fluid motion. In fact, the resulting cloth motion may still be present even if very little free fluid is present. In this process, a laundry item is not considered to be suspended or submerged in the free liquid even if the actual liquid level is near the top of the basket or near the top of the laundry load. The mechanical energy for cleaning the laundry in the low water wash primarily comes from the interaction between the laundry items.

In a vertical axis washing machine with a deep fill wash cycle where the laundry is completely submerged, reciprocal movement of an agitator moves the laundry items along a toroidal, or donut-shaped, path extending radially inwardly toward the center of the basket, downwardly along the vertical axis, radially outwardly toward the outer wall of the basket, and upwardly along the perimeter of the basket where they repeat the cycle. One full cycle along this path is commonly referred to as a "rollover."

In a low water cycle, such as where the laundry items are wetted but not submerged, the movement of the laundry items by reciprocating the impeller moves the laundry items in an opposite direction than that of the agitator with a deep fill in what has been termed an "inverse toroidal rollover." The inverse toroidal rollover typically moves the laundry items along a path extending radially outwardly toward the outer wall of the basket, downwardly along the perimeter of the basket, radially inwardly toward the center of the basket, and upwardly along the vertical axis where they repeat the cycle.

FIG. 1 is a schematic view of a laundry treating appliance according to an exemplary embodiment. The laundry treating appliance may be any appliance that performs a cycle of operation to clean or otherwise treat items placed therein, non-limiting examples of which include a horizontal or vertical axis clothes washing machine, a combination washing machine and dryer, a tumbling or stationary refreshing/revitalizing machine, an extractor, a non-aqueous washing apparatus, and a revitalizing machine.

The laundry treating appliance of FIG. 1 is illustrated as a vertical axis washing machine 10, which may include a structural support system comprising a cabinet 12 that defines a housing within which a laundry holding system resides. The cabinet 12 may be a housing having a chassis and/or a frame, defining an interior receiving components typically found in a conventional washing machine, such as motors, pumps, fluid lines, controls, sensors, transducers, and the like. Such components will not be described further herein except as necessary for a complete understanding of the invention.

The laundry holding system of the illustrated exemplary washing machine 10 may include a watertight tub 14 installed in the cabinet 12. A perforated basket 16 may be mounted in the tub 14 for rotation about an axis of rotation, such as, for example, a central, vertical axis 18 extending through the center of a laundry mover in the form of an impeller 20 as an example. The basket 16 may have a generally cylindrical side wall 22 closed at its bottom end by a base 24 to at least partially define a laundry treating chamber 26 receiving a load of laundry items for treatment. The base 24 formed at the bottom of the basket 16 may have a variable thickness (i.e., vertical height) and may be shaped to accommodate the impeller 20 and provide clearance for the impeller 20. The base 24 may extend from a central hub 28, which may define a central opening, radially outward to the perimeter of the basket 16 where the base 24 joins with the basket side wall 22. Similarly, the tub 14 may be formed by a generally cylindrical tub side wall 30 closed at its bottom end by a base 32 with a central hub 34 defining a central opening. The thickness (i.e., vertical height) of the base 32 may also vary from the central hub 34 to the perimeter of the tub 14 where the base 32 joins with the tub side wall 30. The tub 14 may include a pocket 36 formed in the base 32 to accommodate a heater 38 that may heat liquid held by the tub 14. The bottom of the pocket 36 may form a floor for a sump 37 of the tub 14. The impeller 20 may be mounted within the treating chamber 26 and may be any type of laundry mover, including, but not limited to, an impeller, an agitator, and a combination impeller-agitator.

A drive system including a drive motor 40 may be utilized to rotate the basket 16 and the impeller 20. The impeller 20 may be positioned above the base 24 of the basket 16 and rotated by a drive shaft 42 extending through the central openings formed by the tub central hub 34 and the base central hub 28. The drive system may further include a transmission to transfer rotational force from the motor 40 to the drive shaft 42 and a clutch to selectively transfer rotational force from the drive shaft 42 to the basket 16, such as through a spin tube mounted to the central hub 28 of the basket 16. The motor 40 and associated components may be mounted to the underside of the tub 14 near the central hub 34 by a bracket 44 with a mounting flange 46. The motor 40 may rotate the basket 16 at various speeds, including at a spin speed wherein a centrifugal force at the inner surface of the basket side wall 22 is 1 g or greater; spin speeds are commonly known for use in extracting liquid from the laundry items in the basket 16, such as after a wash or rinse step in a treating cycle of operation. The laundry items may be referred to as being satellized when the basket 16 rotates at a spin speed. The illustrated drive system for the basket 16 and the impeller 20 is provided for exemplary purposes only and is not limited to that shown in the drawings and described above; the particular drive system is not germane to the invention.

A suspension system 50 may dynamically hold the tub 14 within the cabinet 12. The suspension system 50 may dissipate a determined degree of vibratory energy generated by the rotation of the basket 16 and/or the impeller 20 during a treating cycle of operation. Together, the tub 14, the basket 16, and any contents of the basket 16, such as liquid and laundry items, define a suspended mass for the suspension system 50. The suspension system 50 may be any type of suspension system and is not germane to the invention.

The washing machine 10 may be fluidly connected to a liquid supply 52 through a liquid supply system including a valve assembly 54 that may be operated to selectively deliver liquid, such as water, to the tub 14 through a liquid supply outlet 56, which is shown by example as being positioned at one side of the tub 14. The washing machine 10 may further include a recirculation and drain system having a pump assembly 58 that may pump liquid from the tub 14 back into the tub 14 for recirculation of the liquid and/or to a drain conduit to drain the liquid from the machine 10. The illustrated liquid supply system and recirculation and drain system for the washing machine 10 are provided for exemplary purposes only and are not limited to those shown in the drawings and described above; the particular liquid supply system and recirculation and drain system are not germane to the invention.

The washing machine 10 may further include a control system for controlling the operation of the washing machine 10 to implement one or more treating cycles of operation. The control system may include a controller 60 located within a console 61 or elsewhere, such as within the cabinet 12, and a user interface 62 that is operably coupled with the controller 60. The user interface 62 may include one or more knobs, dials, switches, displays, touch screens and the like for communicating with the user, such as to receive input and provide output. The user may enter different types of information including, without limitation, cycle selection and cycle parameters, such as cycle options.

The controller 60 may include the machine controller and any additional controllers provided for controlling any of the components of the washing machine 10. For example, the controller 60 may include the machine controller and a motor controller. Many known types of controllers may be used for the controller 60. The specific type of controller is not germane to the invention. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
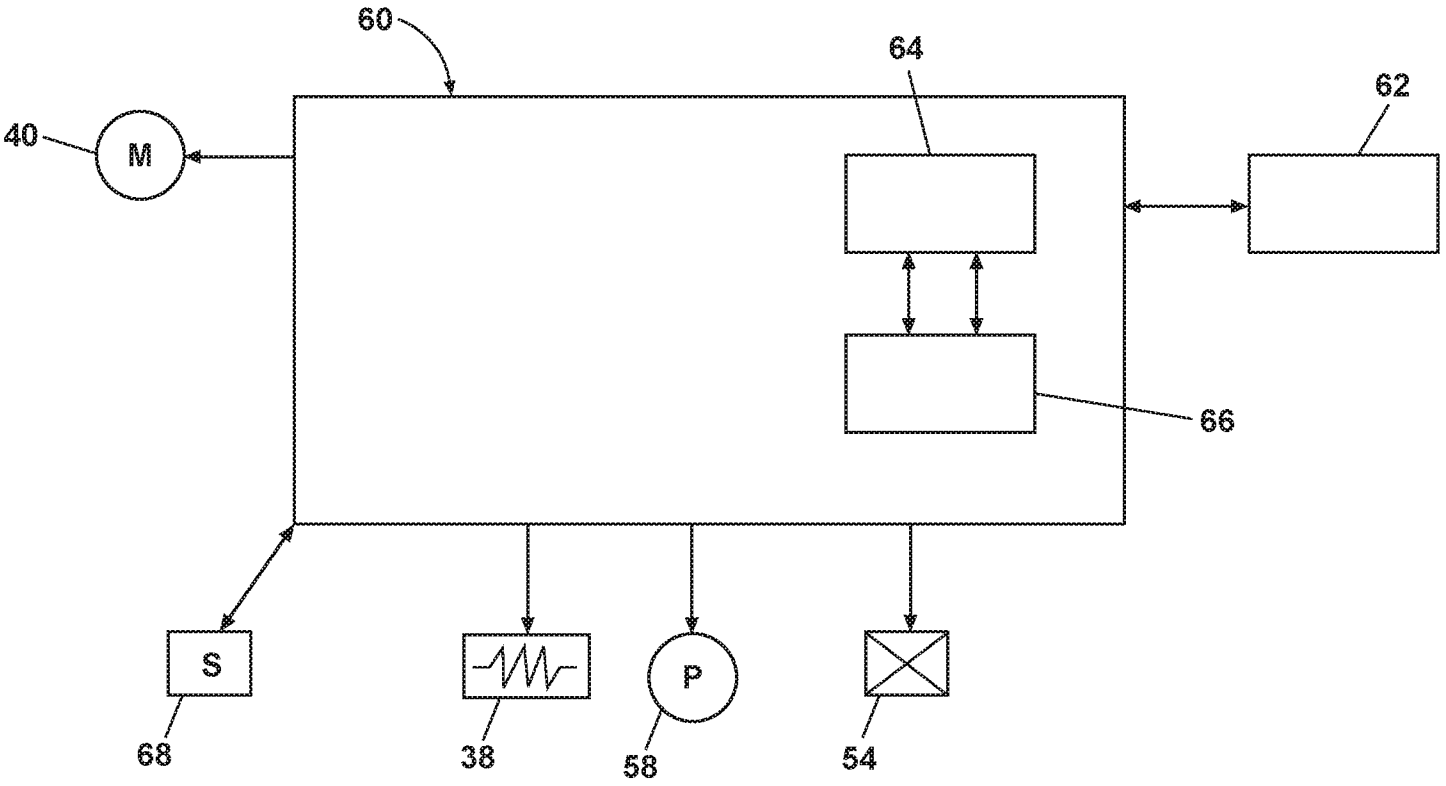
FIG. 2 is a schematic view of a control system for the laundry treating appliance of FIG. 1.

As illustrated in FIG. 2, the controller 60 may be provided with a memory 64 and a central processing unit (CPU) 66. The memory 64 may be used for storing the control software that is executed by the CPU 66 in completing a treating cycle of operation using the washing machine 10 and any additional software. Examples, without limitation, of treating cycles of operation include: wash, heavy duty wash, delicate wash, quick wash, pre-wash, refresh, rinse only, and timed wash. The memory 64 may also be used to store information, such as a database or table, and to store data received from one or more components of the washing machine 10 that may be communicably coupled with the controller 60. The database or table may be used to store the various operating parameters for the one or more cycles of operation, including factory default values for the operating parameters and any adjustments to them by the control system or by user input.

The controller 60 may be operably coupled with one or more components of the washing machine 10 for communicating with and controlling the operation of the component to complete a cycle of operation. For example, the controller 60 may be operably coupled with the motor 40, the valve assembly 54, the pump 58, and the heater 38 to control the operation of these and other components to implement one or more of the cycles of operation. The controller 60 may also be coupled with one or more sensors 68 provided in one or more of the systems of the washing machine 10 to receive input from the sensors, which are known in the art and not shown for simplicity.

Figure 3:
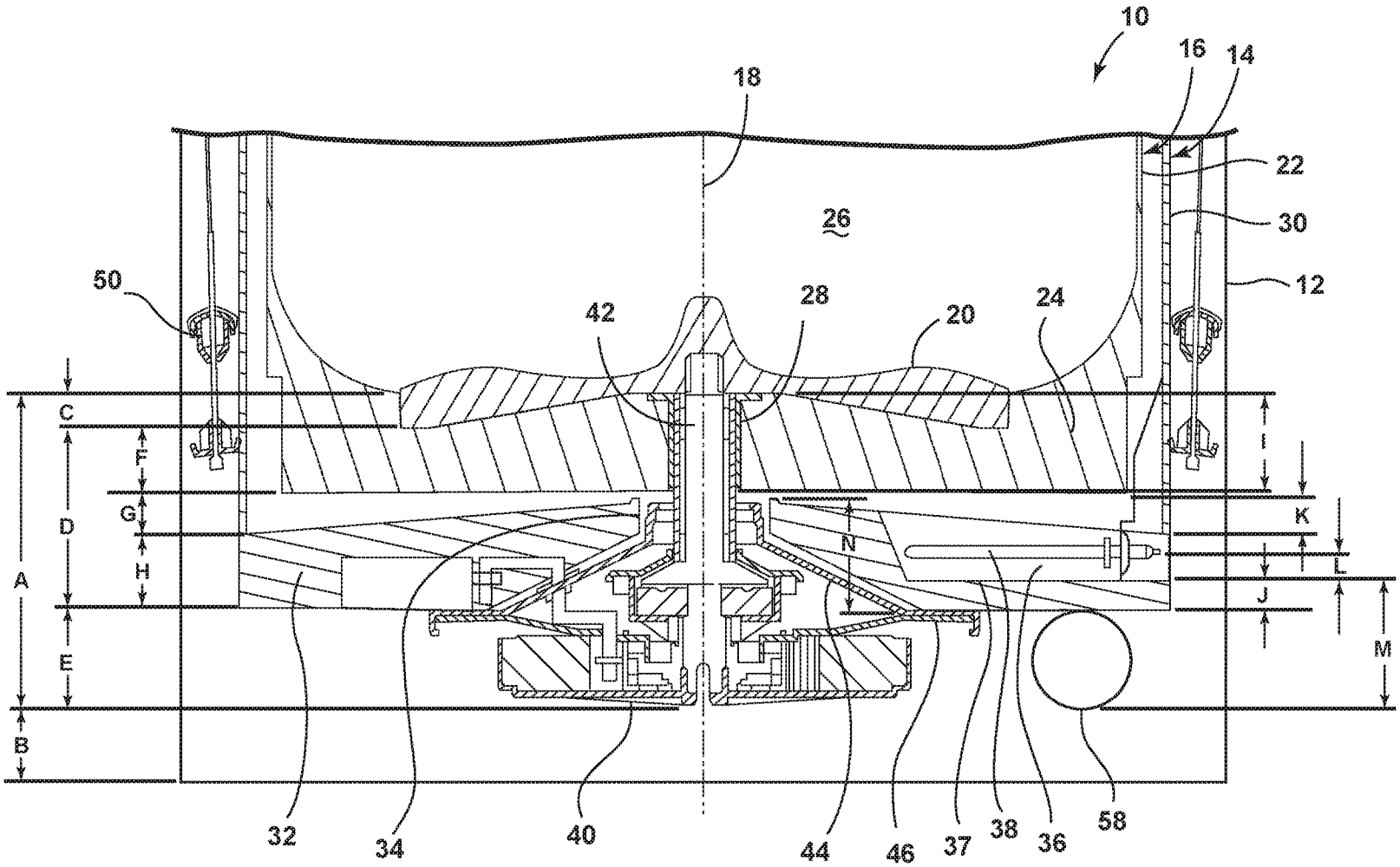
FIG. 3 is an enlarged view of the region identified in FIG. 1.

Referring now to FIG. 3, which in an enlarged view of the lower portion of the washing machine 10 from FIG. 1, the washing machine 10 has a load capacity directly related to the volume of the basket 16 that holds the laundry items. Increasing the volume of the basket 16, such as by increasing the height of the basket side wall 22 and/or increasing the diameter of the basket base 24, corresponds to a larger load capacity. Without altering the size of the cabinet 12, which is normally limited to industry standard sizes, to increase the height of the basket side wall 22, the height of a vertical stack A defined as the distance between the top of the basket central hub 28 to the bottom of the motor 40 must be minimized. The bottom of the motor 40 is flush with the bottom of the pump assembly 58 and is spaced a distance B from the bottom of the machine or floor, which is a fixed, predetermined distance. The distance B provides for travel or vertical movement of the suspended mass and the suspension system 50. The minimization of A requires a balance between several variables, as will be explained below. A description of the other vertical dimensions identified in FIG. 3 will be beneficial in understanding such explanation.

The vertical stack A may be considered the sum of a clearance C for the portion of the impeller 20 that projects below the top of the basket central hub 28, a distance D between the bottom of the impeller 20 to a motor mounting datum defined by the motor mounting flange 46, and a distance E between the motor mounting datum to the bottom of the motor 40. C is a fixed, predetermined distance, and E has a fixed minimum value dependent on the position of the pump assembly 58 (the bottom of the motor 40 need not be above the bottom of pump assembly 58, which has a set position). The distance D may be broken into three separate vertical distances: a basket base coin trap F, a suds/water lock clearance G, and a tub base thickness H at the perimeter of the tub 14. The coin trap F has a predetermined minimum distance to allow for a pocket, which may be V-shaped, that catches coins that may fall out of laundry items. The minimum height for the coin trap F ensures that the coins do not interfere with the rotation of the impeller 20 relative to the basket 16. The suds/water lock clearance G also has a predetermined minimum distance that enables water to drain to the sump 37 of the tub 14 and then to the pump assembly 58 without contacting the bottom of the basket 16. If the collected water at the bottom of the tub 14 backs up enough during draining so that the water contacts the bottom of the basket 16, water and/or suds lock may occur when the basket 16 rotates at a high speed, such as a spin speed, during a subsequent phase of a treating cycle of operation. G is essentially a space rather than a structure and should ideally be kept at its minimum value. The tub base thickness H, which may be variable, at the perimeter of the tub 14 is self-explanatory and is also a primary driver for a stiffness of the tub base 32.

Other dimensions affecting the vertical stack A include a basket base thickness I at the basket central hub 28, which is a primary driver for a stiffness of the basket base 24, and a distance J between the floor of the sump 37 to the motor mounting datum. Additionally, for safety, the heater 38 must have a minimum clearance K relative to the basket base 24 and a minimum clearance L to the floor of the tub sump 37. M relates to the vertical distance required for mounting the pump assembly 58, which is a fixed value dependent on the size of the pump assembly 58, and N is a drive height, which is the distance from the top of the tub central hub 34 to the motor mounting datum and may be fixed for modularity of the drive system across different types of washing machines.

Minimizing the vertical stack A may be accomplished by minimizing one or more of the variable distances described above. At the same time, it is imperative that the stiffness of the basket base 24 and the stiffness of the tub base 32 are matched so that one does not dominate over the other or, conversely, one does not act as a weak link. As used herein, "matched" is intended to mean that the stiffnesses are substantially the same for practical purposes, but they do not need to be identical. If the stiffness of the basket base 24 and the stiffness of the tub base 32 are substantially the same, then any deflection of the basket 16 and the tub 14 that may occur during rotation of basket 16, such as during rotation of the basket 16 at a spin speed, will be substantially the same. It has been calculated that the effective stiffnesses, that is, the stiffnesses exhibited by the basket base 24 and the tub base 32, are matched functionally or are substantially the same such that the degree of the deflection is about the same when the stiffnesses are within about 15% of each other and especially when within about 5% of each other. If one of the stiffnesses is less than the other by more than about 5-15%, then the basket base 24 or the tub base 32 with the smaller stiffness will undergo increased relative deflection at a given speed, which could damage the washing machine 10 and/or prevent the basket 16 from reaching a desired maximum spin speed. Such deflection may be especially prevalent if the laundry load contains an imbalance as the spin speed approaches a natural resonant frequency. Further, because the tub 14 and the basket 16 are connected by the drive system, an effective stiffness of the drive system should be at least equal to or greater than the stiffnesses of the tub base 32 and the basket base 24 so that it does not function as the weakest link in the system. As an analogy, the tub 14 and the basket 16 can be thought of as springs having matched stiffnesses or spring constants connected by the drive system; a connector with a lower stiffness or spring constant than the two springs would undesirably function as a weak link.

Another factor to consider when aiming to minimize the vertical stack to increase load capacity is a desired maximum spin speed and a desired time for a treating cycle of operation. For a given amount of liquid extraction, cycle time can be desirably decreased if a higher maximum spin speed can be reached. In order to reach higher spin speeds, the stiffnesses of the basket base 24 and the tub base 32 must be sufficiently high to handle the stresses imposed on the basket 16 and the tub 14 at the high speeds. Additionally, as mentioned above, the stiffnesses should be matched so that as the spin speed increases and approaches a natural resonant frequency of the machine, any deflection of the basket 16 and the tub 14 that may occur is about the same degree. Hence, a tradeoff exists between maximum spin speed and load capacity; increasing thicknesses of the basket base 24 and the tub base 32 to increase the stiffnesses for reaching a higher maximum spin speed corresponds to decreasing the height of the basket side wall 22 and, thus, the load capacity.

With the goal of increasing load capacity, one can turn to minimizing the vertical stack A by minimizing one or more of the variable distances described above, keeping in mind the constraints of matching the stiffnesses of the basket base 24 and the tub base 32 and achieving a high maximum spin speed. For example, the tub base thickness H at the perimeter of the tub 14 and the basket base thickness I at the basket central hub 28 can be decreased or increased, while the coin trap F and the suds/water lock clearance G must be maintained at or above their minimum values. Decreasing H provides more structure and stiffness in the basket base 24 (increase I), while increasing H provides more structure and stiffness in the tub base 32 at the expense of that of the basket base 24 (decrease I). Ideally, increased load capacity is achieved by minimizing I while retaining sufficient basket base stiffness, while optimizing F and H to reach the minimum coin trap F and desired stiffness of the tub base 32, respectively. In a sense, achieving the matched stiffnesses may be accomplished by matching the thicknesses H, I. Here, the matched thickness does not necessarily mean that the thicknesses H, I are substantially the same; while the thicknesses H, I might be substantially the same, they might also be different so long as the thicknesses H, I are matched to effect the matched stiffnesses of the basket base 24 and the tub base 32.

Computer calculations employing a virtual model of the washing machine 10 with the vertical stack A and constraints related to matching stiffnesses of the basket base 24 and the tub base 32, the maximum spin speed, and materials for the basket 16 determined that for one exemplary vertical axis washing machine, the load capacity can be maximized at about 170 liters (6 $ft^3$) when the thickness I of the basket base central hub 28 is between 45 mm (1.77 in.) and 70 mm (2.76 in.) and the thickness H of the tub base central hub 34 is between about 25 mm (0.98 in.) and 50 mm (1.97 in.). When the thickness I is between about 45 mm (1.77 in.) and 55 mm (2.17 in.), an aluminum basket base is recommended, while a plastic clamshell basket base may be employed when the thickness I is greater than about 55 mm (2.17 in.).

For this example, the maximum spin speed may be about 1100 rpm, which is about 5 Hz below a first, rocking mode natural resonance frequency of the washing machine 10. In general, the washing machine 10 may be designed so that the maximum spin speed is about 5 Hz below the first, rocking mode natural resonance frequency of the suspended mass comprising the tub 14, the basket 16, and the contents of the basket 16 held by the suspension system 50. Doing so avoids the spin speed from reaching the natural resonance frequency and corresponding significant deflection that may occur upon reaching such frequency, especially if the laundry load is unbalanced. By matching the stiffnesses as described above, as the spin speed increases and approaches the natural resonance frequency, the deflection that may start to occur will be about the same for the tub 14 and the basket 16 such that one of the two does not undergo excessive rocking movement prematurely and cause the spin cycle to end prematurely. Many known methods exist for monitoring and testing the amount of deflection of the tub 14 and/or the basket 16, including analyzing data obtained from the motor 40 that controls the speed of the basket 16, and using sensors located in the washing machine 10, such as motion sensors on the tub 14 and/or the basket 16 or sensors located on the cabinet that sense movement of the tub 14 and/or the basket 16.

While the invention has been specifically described in connection with certain specific embodiments thereof, it is to be understood that this is by way of illustration and not of limitation, and the scope of the appended claims should be construed as broadly as the prior art will permit.

What is claimed is:

1. A laundry treating appliance comprising:

a tub;

a basket located at least partially within the tub and at least partially defining a laundry treating chamber; and a drive system operatively coupling the tub to the basket and operative to rotate the basket about a rotational axis; and wherein the tub and the basket undergo about the same degree of deflection relative to each other when the drive system rotates the basket at a spin speed, further comprising a cabinet and a suspension system resiliently holding the tub and the basket within the cabinet, wherein the suspension system, the tub, the basket, and contents of the basket collectively define a suspended mass, wherein the tub and the basket undergo about the same degree of deflection relative to each other when the drive system rotates the basket at the spin speed, which corresponds to a first natural resonance frequency of the suspended mass.

2. The laundry treating appliance according to claim 1 wherein the spin speed is about 5 Hz lower than the first natural resonance frequency of the suspended mass.

3. The laundry treating appliance according to claim 1 wherein the spin speed is about 1100 rpm.

4. The laundry treating appliance according to claim 1 wherein the first natural resonance frequency of the suspended mass is a rocking mode natural resonance frequency.

5. The laundry treating appliance according to claim 1 wherein the spin speed is a rotational speed above where laundry within the basket satellizes against the basket with a centrifugal force at an inner surface of the basket being 1 g or greater.

6. The laundry treating appliance according to claim 5 wherein the spin speed is about 1100 rpm.

7. A laundry treating appliance comprising: a tub having a tub base;

a basket located at least partially within the tub and at least partially defining a laundry treating chamber, the basket having a basket base; and a drive system operatively coupling the tub to the basket and operative to rotate the basket about a rotational axis; and wherein the base of the tub and the base of the basket undergo about the same degree of deflection relative to each other when the drive system rotates the basket at a spin speed wherein laundry within the basket satellizes against the basket with a centrifugal force at an inner surface of the basket being 1 g or greater, wherein the same degree of deflection is accomplished by the tub base and basket base having matched thickness.

8. The laundry treating appliance of claim 7 wherein the basket base has a central hub with a thickness between about 45 mm and 70 mm.

9. The laundry treating appliance of claim 8 wherein the basket base is made from metal when the central hub thickness is less than about 55 mm.

10. The laundry treating appliance of claim 8 wherein the basket base is made from plastic when the central hub thickness is greater than about 55 mm.

11. The laundry treating appliance of claim 8 wherein the tub base has an outer periphery with a thickness between about 25 mm and 50 mm.

12. The laundry treating appliance of claim 11 wherein the tub base outer periphery thickness is about 50 mm.

* * * * *